US006550929B1

(12) United States Patent
Dumas

(10) Patent No.: US 6,550,929 B1
(45) Date of Patent: Apr. 22, 2003

(54) ATTACHABLE AND GLOWABLE MEMBERS

(76) Inventor: Glenn A. Dumas, 21550 Box Springs Rd. #1061, Moreno Valley, CA (US) 92557

( * ) Notice: Subject to any disclaimer, the term of this patent is extended or adjusted under 35 U.S.C. 154(b) by 0 days.

(21) Appl. No.: 09/999,138

(22) Filed: Nov. 30, 2001

(51) Int. Cl.[7] ..... F21W 121/06; F21V 21/08; F21K 2/06

(52) U.S. Cl. ..... 362/84; 362/103; 362/249; 362/806

(58) Field of Search ..... 362/806, 103, 362/104, 84, 227, 249

(56) References Cited

U.S. PATENT DOCUMENTS 3,508,754 A 4/1970 Shorin
4,405,973 A 9/1983 Moscarillo
4,635,166 A * 1/1987 Cameron ..... 362/84
5,121,302 A * 6/1992 Bay et al. ..... 362/84
5,811,174 A 9/1998 Murakami
5,856,029 A 1/1999 Burrows
D415,344 S 10/1999 Leibowitz
5,989,667 A 11/1999 Tayebi

* cited by examiner

*Primary Examiner*—Laura K. Tso

(57) ABSTRACT

An attachable and glowable members for giving the user a unique, glowing appearance, The attachable and glowable members includes a plurality of disc members each having a front side, a back side and a cavity disposed therein with the disc members being capable of attaching to objects; and also includes glow-able substances being disposed in the cavities of the disc members for producing fluorescence upon the disc members being folded and shaken; and further includes adhesives being disposed upon the back sides of the disc members and being protected with removable covers for attaching the disc members to the objects.

4 Claims, 1 Drawing Sheet

ATTACHABLE AND GLOWABLE MEMBERS

BACKGROUND OF THE INVENTION

1. Field of the Invention

The present invention relates to fluorescent members and more particularly pertains to a new attachable and glowable members for giving the user a unique, glowing appearance.

2. Description of the Prior Art

The use of fluorescent members is known in the prior art. More specifically, fluorescent members heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,508,754; U.S. Pat. No. 4,405,973; U.S. Pat. No. 5,989,667; U.S. Pat. No. 5,811,174; U.S. Pat. No. 5,856,029; and U.S. Pat. No. Des. 41 5,344.

While these devices fulfill their respective, particular objectives and requirements, the aforementioned patents do not disclose a new attachable and glowable members. The inventive device includes a plurality of disc members each having a front side, a back side and a cavity disposed therein and with the disc members being capable of attaching to objects; and also includes glow-able substances being disposed in the cavities of the disc members for producing fluorescence upon the disc members being folded and shaken; and further includes adhesives being disposed upon the back sides of the disc members and being protected with removable covers for attaching the disc members to the objects.

In these respects, the attachable and glowable members according to the present invention substantially departs from the conventional concepts and designs of the prior art, and in so doing provides an apparatus primarily developed for the purpose of giving the user a unique, glowing appearance.

SUMMARY OF THE INVENTION

In view of the foregoing disadvantages inherent in the known types of fluorescent members now present in the prior art, the present invention provides a new attachable and glowable members construction wherein the same can be utilized for giving the user a unique, glowing appearance.

The general purpose of the present invention, which will be described subsequently in greater detail, is to provide a new attachable and glowable members which has many of the advantages of the fluorescent members mentioned heretofore and many novel features that result in a new attachable and glowable members which is not anticipated, rendered obvious, suggested, or even implied by any of the prior art fluorescent members, either alone or in any combination thereof.

To attain this the present invention generally comprises a plurality of disc members each having a front side, a back side and a cavity disposed therein and with the disc members being capable of attaching to objects; and also includes glow-able substances being disposed in the cavities of the disc members for producing fluorescence upon the disc members being folded and shaken; and further includes adhesives being disposed upon the back sides of the disc members and being protected with removable covers for attaching the disc members to the objects.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new attachable and glowable members which has many of the advantages of the fluorescent members mentioned heretofore and many novel features that result in a new attachable and glowable members which is not anticipated, rendered obvious, suggested, or even implied by any of the prior art fluorescent members, either alone or in any combination thereof.

It is another object of the present invention to provide a new attachable and glowable members which may be easily and efficiently manufactured and marketed.

It is a further object of the present invention to provide a new attachable and glowable members which is of a durable and reliable construction.

An even further object of the present invention is to provide a new attachable and glowable members which is susceptible of a low cost of manufacture with regard to both materials and labor, and which accordingly is then susceptible of low prices of sale to the consuming public, thereby making such attachable and glowable members economically available to the buying public.

Still yet another object of the present invention is to provide a new attachable and glowable members which provides in the apparatuses and methods of the prior art some of the advantages thereof, while simultaneously overcoming some of the disadvantages normally associated therewith.

Still another object of the present invention is to provide a new attachable and glowable members for giving the user a unique, glowing appearance.

Yet another object of the present invention is to provide a new attachable and glowable members which includes a plurality of disc members each having a front side, a back side and a cavity disposed therein with the disc members being capable of attaching to objects; and also includes glow-able substances being disposed in the cavities of the disc members for producing fluorescence upon the disc members being folded and shaken; and further includes adhesives being disposed upon the back sides of the disc members and being protected with removable covers for attaching the disc members to the objects.

Still yet another object of the present invention is to provide a new attachable and glowable members that are easy and convenient to use.

Even still another object of the present invention is to provide a new attachable and glowable members that would provide fun at night and at events and also allows others to see you in the dark.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 2:
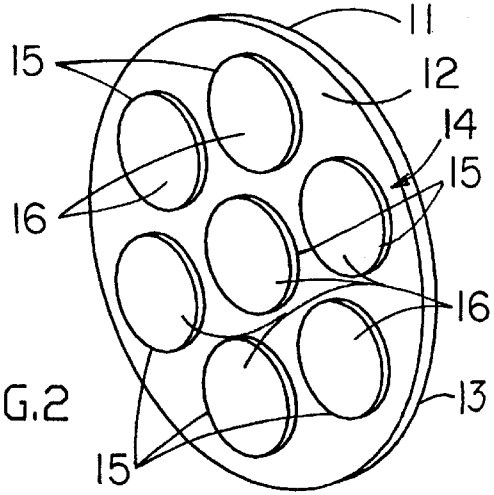
FIG. 2 is a side edge view of the present invention.
Figure 4:
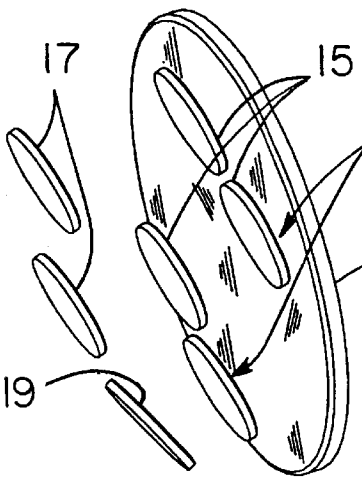
FIG. 4 is an exploded perspective view of the present invention.
Figure 1:
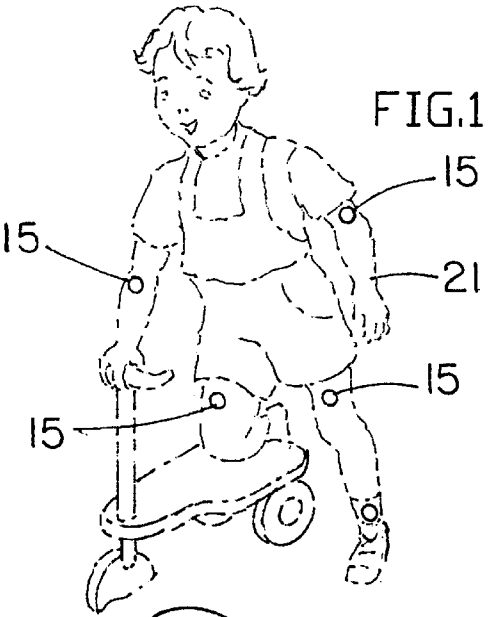
FIG. 1 is a perspective view of a new attachable and glowable members according to the present invention and shown in use.
Figure 3:
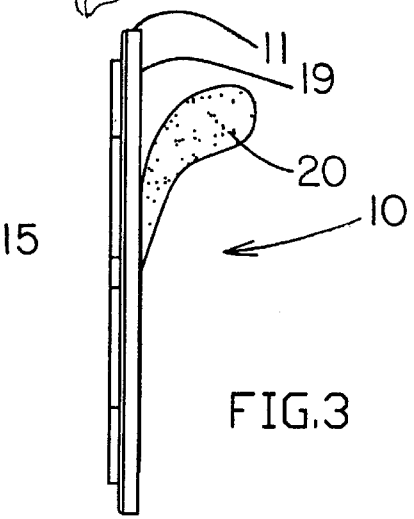
FIG. 3 is a perspective view of the present invention.

With reference now to the drawings, and in particular to FIGS. 1 through 4 thereof, a new attachable and glowable members embodying the principles and concepts of the present invention and generally designated by the reference numeral 10 will be described.

As best illustrated in FIGS. 1 through 4, the attachable and glowable members 10 generally comprises a plurality of disc members 11,15 each having a front side 12,16, a back side 13,17 and a cavity 14,18 being disposed therein with the disc members 11,15 being capable of attaching to objects 21. The disc members 11,15 include a base disc member 11 and a plurality of patch-like disc members 15 being adherable to the front side 12 of the base disc member 11. The disc members 11,15 are adapted to removably adhere to clothing and to skin 21 of a user. The patch-like disc in members 15 are relatively smaller than the base disc member 11.

Glow-able substances are disposed in the cavities 14,18 of the disc members 11,15 for producing fluorescence upon the disc members 11,15 being folded and shaken. The glow-able substances include cyalume chemicals. Adhesives 19 are conventionally disposed upon the back sides 13,17 of the disc members 11,15 and are protected with removable covers 20 for attaching the disc members 11,15 to the objects 21.

In use, the user bends and shakes the disc members 11,15 to mix the cyalume chemicals to produce fluorescence, and the user then peels off the removal covers 20 from the back sides 13,17 of the disc members 11,15 and attaches the disc members 11,15 to the objects including a person's clothing and skin 21.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. Attachable and glow-able members comprising:

a plurality of disc members each having a front side, a back side and a cavity disposed therein with said disc members being capable of attaching to objects;

glow-able substances being disposed in said cavities of said disc members for producing fluorescence upon said disc members being folded and shaken;

adhesives being disposed upon said back sides of said disc members and being protected with removable covers for attaching said disc members to the objects; and wherein said disc members includes a base disc member and a plurality of patch-like disc members removably adhered to said front side of said base disc member, said disc members being adapted to removably adhere to clothing and to skin of a user.

2. Attachable and glow-able members as described in claim 1, wherein said patch-like disc members are relatively smaller than said base disc member.

3. Attachable and glow-able members as described in claim 1, wherein said glow-able substances include cyalume chemicals.

4. Attachable and glow-able members comprising:

a plurality of disc members each having a front side, a back side and a cavity disposed therein with said disc members being capable of attaching to objects said disc members including a base disc member and a plurality of patch-like disc members being removably adhered to said front side of said base disc member, said disc members being adapted to removably adhere to clothing and to skin of a user, said patch-like disc members being relatively smaller than said base disc member;

glow-able substances being disposed in said cavities of said disc members for producing fluorescence upon said disc members being folded and shaken, said glow-able substances including cyalume chemicals; and adhesives being disposed upon said back sides of said disc members and being protected with removable covers for attaching said disc members to the objects.

* * * * *